US006758448B1

(12) United States Patent
Williams et al.

(10) Patent No.: US 6,758,448 B1
(45) Date of Patent: Jul. 6, 2004

(54) BACKSTOP SUPPORT ASSEMBLY FOR A SHELVING UNIT

(76) Inventors: Dicky L. Williams, 6400 Brown La., Noble, OK (US) 73068; Pamela K. Williams, 6400 Brown La., Noble, OK (US) 73068

( * ) Notice: Subject to any disclaimer, the term of this patent is extended or adjusted under 35 U.S.C. 154(b) by 0 days.

(21) Appl. No.: 10/224,636

(22) Filed: Aug. 20, 2002

(51) Int. Cl.[7] ..... A41F 5/00

(52) U.S. Cl. ..... 248/125.1; 248/316.8; 248/244

(58) Field of Search ..... 248/125.1, 122.1, 248/235, 241, 243, 244, 245, 250, 218.4, 219.1, 229.1, 229.15, 121, 125.3, 188.1, 519, 530, 227.3, 295.11, 316.8; 211/192, 103

(56) References Cited

U.S. PATENT DOCUMENTS 1,486,594 A * 3/1924 Malone ..... 52/154
3,198,470 A * 8/1965 Owens ..... 248/245
4,079,678 A * 3/1978 Champagne ..... 108/110
4,131,204 A * 12/1978 Jacoby et al. ..... 211/192
4,666,131 A * 5/1987 Kettelkamp et al. ..... 256/59
4,819,900 A * 4/1989 Funk ..... 248/244
4,995,206 A * 2/1991 Colonias et al. ..... 52/298
5,236,095 A * 8/1993 Krizka ..... 211/96
5,253,835 A * 10/1993 Herron, III ..... 248/220.22
5,624,045 A * 4/1997 Highsmith et al. ..... 211/192
5,657,884 A * 8/1997 Zilincar, III ..... 211/86.01
5,695,078 A * 12/1997 Otema ..... 211/103
6,293,058 B1 * 9/2001 Sink ..... 52/127.1
6,336,620 B1 * 1/2002 Belli ..... 248/519

* cited by examiner

*Primary Examiner*—Anita King

(57) ABSTRACT

A backstop support assembly for a shelving unit for supporting a backstop member to prevent items from falling off open back shelving units. The backstop support assembly for a shelving unit includes bracket members being adapted to securely fasten with fasteners to a floor; and also includes pole members being securely fastened to the bracket members and being vertically erected upon the floor; and further includes sleeve members being adjustably fastened to the pole members; and also includes backstop support members being attached to the sleeve members for supporting a backstop member positioned behind a shelving unit.

3 Claims, 4 Drawing Sheets

BACKSTOP SUPPORT ASSEMBLY FOR A SHELVING UNIT

BACKGROUND OF THE INVENTION

1. Field of the Invention

The present invention relates to backstop supports and more particularly pertains to a new backstop support assembly for a shelving unit for supporting a backstop member to prevent items from falling off open back shelving units.

2. Description of the Prior Art

The use of backstop supports is known in the prior art. More specifically, backstop supports heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,913,508; U.S. Pat. No. 4,131,204; U.S. Pat. No. 5,624,045; U.S. Pat. No. 3,747,898; U.S. Pat. No. 3,660,871; and U.S. Pat. No. Des. 249,365.

While these devices fulfill their respective, particular objectives and requirements, the aforementioned patents do not disclose a new backstop support assembly for a shelving unit. The prior art includes inventions having pole members and brackets mounted to the pole members.

SUMMARY OF THE INVENTION

The general purpose of the present invention, which will be described subsequently in greater detail, is to provide a new backstop support assembly for a shelving unit which has many of the advantages of the backstop supports mentioned heretofore and many novel features that result in a new backstop support assembly for a shelving unit which is not anticipated, rendered obvious, suggested, or even implied by any of the prior art backstop supports, either alone or in any combination thereof. The present invention includes bracket members being adapted to securely fasten with fasteners to a floor; and also includes pole members being securely fastened to the bracket members and being vertically erected upon the floor; and further includes sleeve members being adjustably fastened to the pole members; and also includes backstop support members being attached to the sleeve members for supporting a backstop member positioned behind a shelving unit. None of the prior art describes the bracket members and the arm members of the present invention.

There has thus been outlined, rather broadly, the more important features of the backstop support assembly for a shelving unit in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new backstop support assembly for a shelving unit which has many of the advantages of the backstop supports mentioned heretofore and many novel features that result in a new backstop support assembly for a shelving unit which is not anticipated, rendered obvious, suggested, or even implied by any of the prior art backstop supports, either alone or in any combination thereof.

Still another object of the present invention is to provide a new backstop support assembly for a shelving unit for supporting a backstop member to prevent items from falling off open back shelving units.

Still yet another object of the present invention is to provide a new backstop support assembly for a shelving unit that is easy and convenient to set up and use.

Even still another object of the present invention is to provide a new backstop support assembly for a shelving unit that prevents injuries to workers working around the shelving units because the items placed on the shelving units can't fall off and hit the workers.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
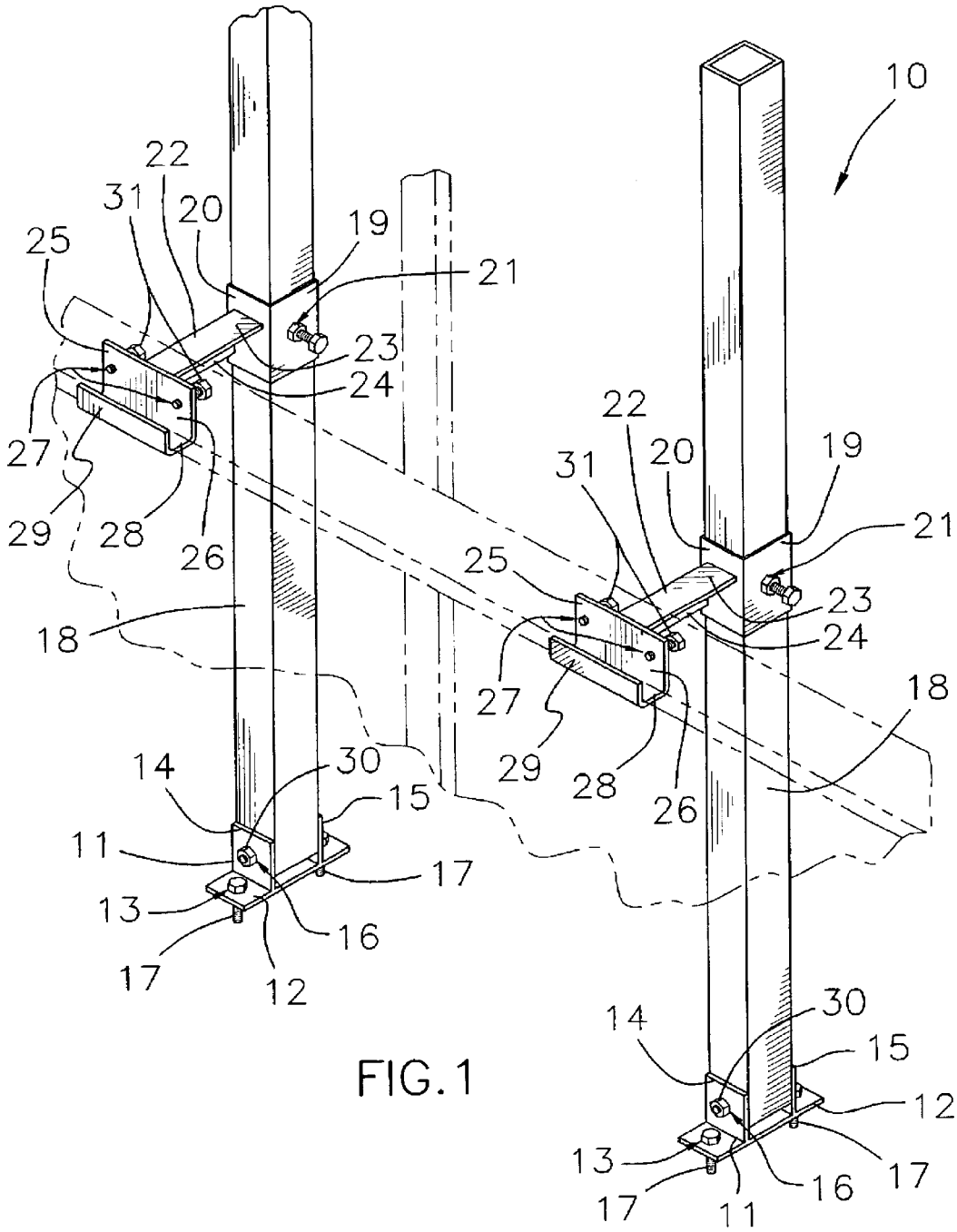
FIG. 1 is a perspective view of a new backstop support assembly for a shelving unit according to the present invention and shown in use.
Figure 2:
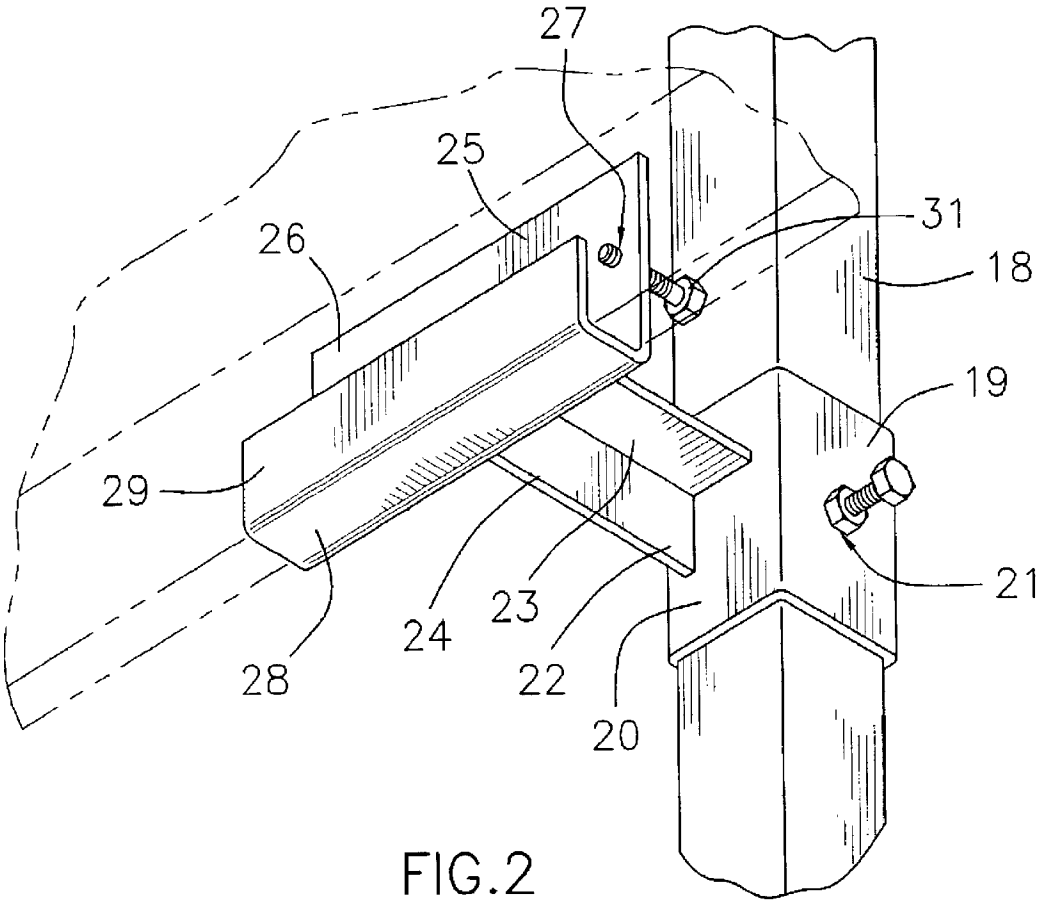
FIG. 2 is a detailed perspective view of one of the sleeves and backstop support members of the present invention.
Figure 3:
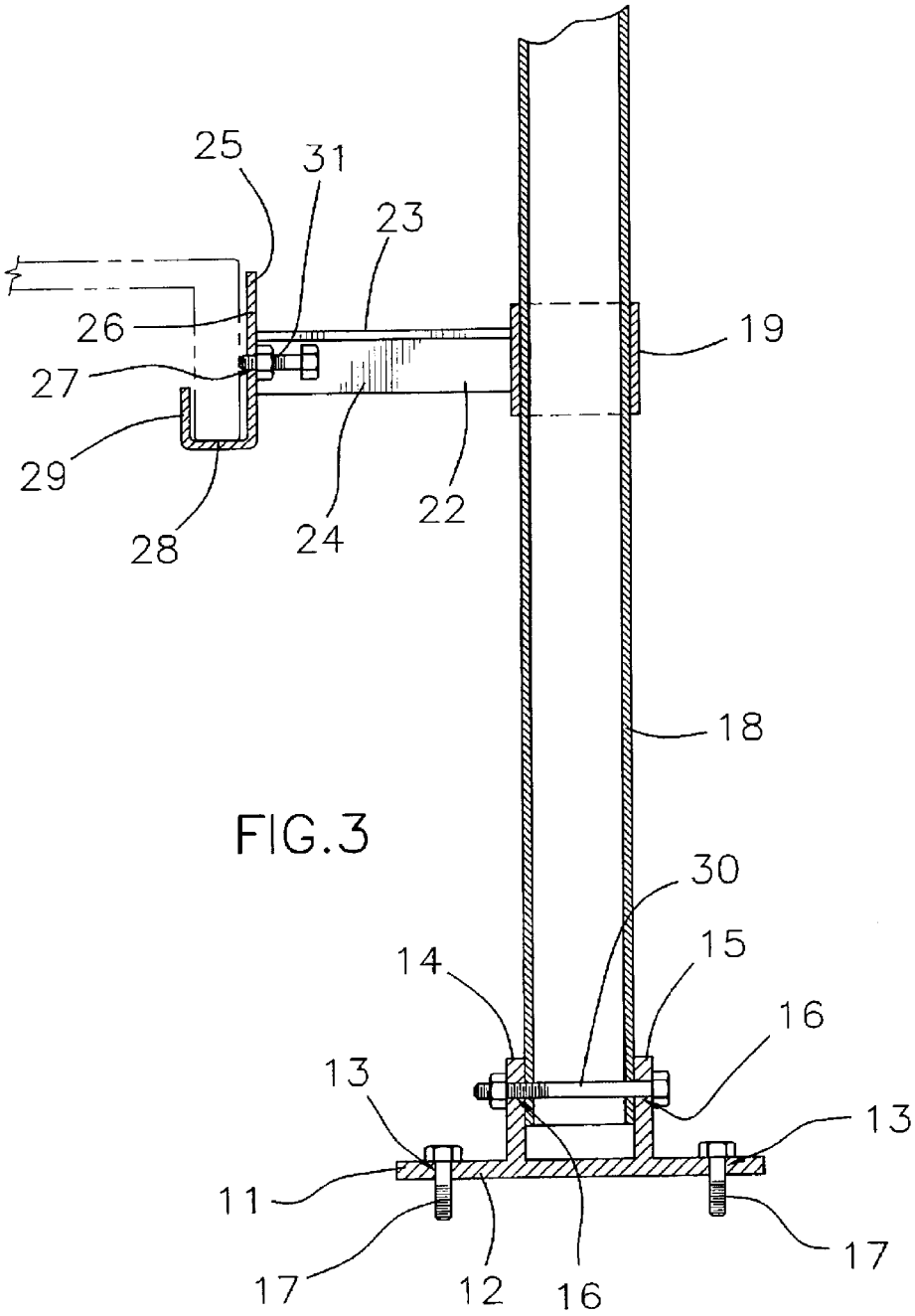
FIG. 3 is a side elevational view of the present invention.
Figure 4:
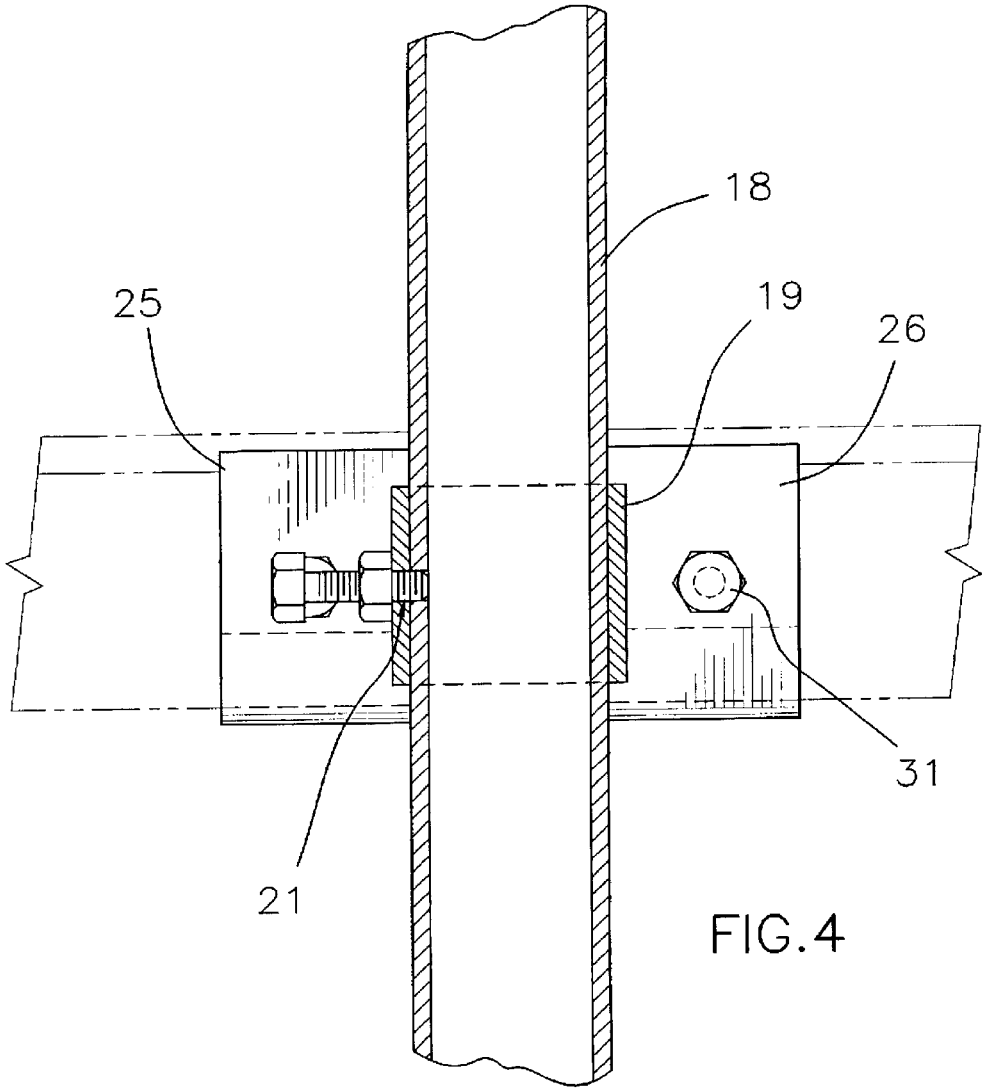
FIG. 4 is a detailed rear elevational view of one of the sleeves and backstop support members of the present invention.

With reference now to the drawings, and in particular to FIGS. 1 through 4 thereof, a new backstop support assembly for a shelving unit embodying the principles and concepts of the present invention and generally designated by the reference numeral 10 will be described.

As best illustrated in FIGS. 1 through 4, the backstop support assembly for a shelving unit 10 generally comprises a pair of bracket members 11 being adapted to securely fasten with fasteners 17 to a floor. Each of the bracket members 11 includes a base member 12 having holes 13 therein for receiving the fasteners 17, and also includes a pair of plate members 14,15 being spaced apart and conventionally attached to and extending outwardly from the base member 12 with each of the plate members 14,15 having a hole 16 extending therethrough for receiving a fastening member 30.

A pair of pole members 18 are securely fastened to the bracket members 11 and are vertically erected upon the floor.

Each of the pole members 18 has a bottom end which is disposed upon a respective bracket member 11 and between the pair of plate members 14,15 and are fastened with the fastening member 30 to the pair of plate members 14,15.

Sleeve members 19 are adjustably fastened to the pole members 18. Each of the sleeve members 19 has a hole 21 extending through a wall 20 thereof and is adjustably and fastenably slidable upon a respective pole member 18.

Backstop support members are conventionally attached to the sleeve members 19 for supporting a backstop member positioned behind a shelving unit. Each of the backstop support members includes an arm member 22 which is securely and conventionally attached and welded to a wall 20 of a respective sleeve member 19 and extends outwardly generally perpendicular from the wall 20 thereof, and also includes a support bracket 25 which is securely and conventionally attached to an end of the arm member 22 and being adapted to support the backstop member, and further includes fastener members 31 for securing the backstop member. Each of the arm members 22 has a first longitudinal portion 23 and a second longitudinal portion 24 both having longitudinal edges which are integrally attached to one another with the second longitudinal portion 24 being angled generally perpendicular to the first longitudinal portion 23. Each of the support brackets 25 includes a main plate-like portion 26 having holes 27 extending therethrough and being adapted to receive the fastener members 31 therethrough, and also includes an intermediate plate-like portion 28 which is integrally attached to a bottom edge of the main plate-like portion 26 and which extends generally perpendicular to the main plate-like portion 26 for supporting the backstop member, and further includes an end plate-like portion 29 which is integrally attached to a front edge of the intermediate plate-like portion 28 and which extends generally perpendicular to the intermediate plate-like portion 28 and which is spacedly disposed generally parallel to the main plate-like portion 26. Each of the support brackets 25 is generally J-shaped.

In use, the user will fasten the bracket members 11 to a floor behind an open back shelving unit, and will fasten the pole members 18 to the bracket members 11, and will position the sleeve members 19 along the pole members 18 so that the backstop member will be supported by the support brackets 25 and be disposed over the open back of the shelving unit so that items and objects placed on the shelving unit cannot fall out the back thereof.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the backstop support assembly for a shelving unit. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim

1. A backstop support assembly for a shelving unit comprising:

bracket members being adapted to securely fasten with fasteners to a floor;

pole members being securely fastened to said bracket members and being vertically erected upon the floor:

sleeve members being adjustably fastened to said pole members; and backstop support members being attached to said sleeve members for supporting a backstop member positioned behind a shelving unit, each of said backstop support members including an arm member which is securely attached to a wall of a respective said sleeve member and extends outwardly generally perpendicular from said wall thereof, and also including a support bracket which is securely attached to an end of said arm member and being adapted to support the backstop member, and further including fastener members for securing the backstop member, each of said arm members having a first longitudinal portion and a second longitudinal portion both having longitudinal edges which are integrally attached to one another with said second longitudinal portion being angled generally perpendicular to said first longitudinal portion.

2. A backstop support assembly for a shelving unit as described in claim 1, wherein each of said support brackets includes a main plate-like portion having holes extending therethrough and being adapted to receive said fastener members therethrough, and also includes an intermediate plate-like portion which is integrally attached to a bottom edge of said main plate-like portion and which extends generally perpendicular to said main plate-like portion for supporting the backstop member, and further includes an end plate-like portion which is integrally attached to a front edge of said intermediate plate-like portion and which extends generally perpendicular to said intermediate plate-like portion and which is spacedly disposed generally parallel to said main plate-like portion.

3. A backstop support assembly for a shelving unit as described in claim 2, wherein each of said support brackets is generally J-shaped.

* * * * *